US010113372B2

(12) United States Patent
Morrison et al.

(10) Patent No.: US 10,113,372 B2
(45) Date of Patent: Oct. 30, 2018

(54) CENTRALIZER

(71) Applicant: Weatherford Technology Holdings, LLC, Houston, TX (US)

(72) Inventors: Jeffery Morrison, Missouri City, TX (US); Brent J. Lirette, Cypress, TX (US); Michael LoGiudice, Cypress, TX (US); Paul L. Smith, Katy, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 642 days.

(21) Appl. No.: 14/447,187

(22) Filed: Jul. 30, 2014

(65) Prior Publication Data

US 2015/0034336 A1 Feb. 5, 2015

Related U.S. Application Data

(60) Provisional application No. 61/860,162, filed on Jul. 30, 2013.

(51) Int. Cl.

| | |
|---|---|
| ***E21B 17/10*** | (2006.01) |
| ***E21B 23/01*** | (2006.01) |
| *E21B 23/06* | (2006.01) |

(52) U.S. Cl.

CPC ..... *E21B 17/1028* (2013.01); *E21B 17/10* (2013.01); *E21B 17/1014* (2013.01); *E21B 17/1021* (2013.01); *E21B 17/1078* (2013.01); *E21B 23/01* (2013.01); *E21B 23/06* (2013.01)

(58) Field of Classification Search

CPC .. E21B 17/1028; E21B 17/1021; E21B 23/01; E21B 23/06; E21B 17/10; E21B 17/1014; E21B 17/1078

See application file for complete search history.

(56) References Cited

U.S. PATENT DOCUMENTS

| | | | | |
|---|---|---|---|---|
| 1,775,376 | A | | 9/1930 | Steps et al. |
| 1,998,833 | A | | 4/1935 | Crowell |
| 2,058,310 | A | | 10/1936 | Hartman et al. |
| 2,089,553 | A | | 8/1937 | Hartman et al. |
| 2,344,120 | A | | 3/1944 | Baker |
| 2,387,493 | A | | 10/1945 | Brokaw |
| 2,460,561 | A | | 2/1949 | Winkelmann et al. |
| 2,654,435 | A | | 10/1953 | Oliver et al. |
| 2,841,226 | A | * | 7/1958 | Conrad ..... E21B 17/1028 166/213 |
| 2,845,128 | A | | 7/1958 | Clark et al. |
| 3,062,297 | A | | 11/1962 | Tyrrell, Jr. |

(Continued)

FOREIGN PATENT DOCUMENTS

| | | |
|---|---|---|
| DE | G8903038.9 | 6/1989 |

OTHER PUBLICATIONS

PCT Search Report and Written Opinion for International Application No. PCT/US2014/048940 dated Apr. 7, 2015.

(Continued)

*Primary Examiner* — D. Andrews
*Assistant Examiner* — Tara E Schimpf
(74) *Attorney, Agent, or Firm* — Patterson + Sheridan, LLP

(57) ABSTRACT

A centralizer having bow springs in a retracted position to facilitate passage through a restriction. After passing through the restriction, the bow springs may be expanded to support a casing. In one embodiment, the bow springs may be expanded using a movable sleeve.

20 Claims, 10 Drawing Sheets

(56) References Cited

U.S. PATENT DOCUMENTS

| | | | | |
|---|---|---|---|---|
| 4,077,470 | A | 3/1978 | Dane | |
| 4,269,269 | A | 5/1981 | Wilson | |
| 4,506,219 | A | 3/1985 | Lee | |
| 4,580,632 | A | 4/1986 | Reardon | |
| 4,669,541 | A | 6/1987 | Bissonnette | |
| 5,033,459 | A | 7/1991 | Champeaux et al. | |
| 5,238,062 | A | 8/1993 | Reinholdt | |
| 5,261,488 | A | 11/1993 | Gullet et al. | |
| 5,346,016 | A | 9/1994 | Wilson et al. | |
| 5,575,333 | A | 11/1996 | Lirette et al. | |
| 6,209,638 | B1 | 4/2001 | Mikolajczyk | |
| 6,298,883 | B1 | 10/2001 | Kinzel | |
| 6,298,889 | B1 | 10/2001 | Smith | |
| 6,453,998 | B1 | 9/2002 | Reeve | |
| 6,453,999 | B1 | 9/2002 | Reinholdt | |
| 6,484,803 | B1 | 11/2002 | Gremillion | |
| 7,140,432 | B2 | 11/2006 | Gremillion | |
| 7,156,171 | B2 | 1/2007 | Gremillion | |
| 7,182,131 | B2 | 2/2007 | Gremillion | |
| 8,245,777 | B2 | 8/2012 | Gamer | |
| 8,505,624 | B2 | 8/2013 | Levie | |
| D718,342 | S | 11/2014 | Buytaert et al. | |
| 8,991,487 | B2 | 3/2015 | Levie et al. | |
| 2002/0112853 | A1* | 8/2002 | Buytaert | E21B 17/1028 166/241.6 |
| 2002/0139537 | A1 | 10/2002 | Young et al. | |
| 2002/0139538 | A1 | 10/2002 | Young et al. | |
| 2007/0144731 | A1* | 6/2007 | Murray | E21B 23/00 166/120 |
| 2007/0235199 | A1 | 10/2007 | LoGiudice et al. | |
| 2008/0283237 | A1 | 11/2008 | Buytaert et al. | |
| 2010/0018698 | A1 | 1/2010 | Gamer | |
| 2010/0181079 | A1 | 7/2010 | Johnson et al. | |
| 2012/0006533 | A1 | 1/2012 | Barnard et al. | |
| 2012/0055667 | A1* | 3/2012 | Ingram | E21B 33/1208 166/65.1 |
| 2012/0145410 | A1 | 6/2012 | Levie | |
| 2012/0186828 | A1* | 7/2012 | Lively | E21B 17/1078 166/381 |
| 2012/0239345 | A1* | 9/2012 | Fraser | E21B 17/1021 702/157 |
| 2013/0025881 | A1 | 1/2013 | Buytaert et al. | |
| 2013/0087334 | A1 | 4/2013 | Buytaert et al. | |
| 2013/0118752 | A1 | 5/2013 | Hannegan et al. | |
| 2013/0248206 | A1 | 9/2013 | Jordan et al. | |
| 2013/0319689 | A1 | 12/2013 | Levie et al. | |
| 2013/0319690 | A1 | 12/2013 | Levie et al. | |
| 2014/0182839 | A1 | 7/2014 | McDaniel et al. | |
| 2015/0034336 | A1 | 2/2015 | Morrison et al. | |
| 2015/0376960 | A1 | 12/2015 | Rodrigue et al. | |

OTHER PUBLICATIONS

Expand-O-Lizer Sub Info Sheet, BK Oil Tools B.V., Heemskerk, The Netherlands, date unknown, one page.

* cited by examiner

CENTRALIZER

CROSS-REFERENCE TO RELATED APPLICATIONS

This application claims benefit of U.S. provisional patent application Ser. No. 61/860,162, filed Jul. 30, 2013, which is herein incorporated by reference in its entirety.

BACKGROUND OF THE INVENTION

Field of the Invention

Embodiments of the present invention generally relate to a centralizer for use in wellbore operations. In particular, embodiments of the present invention relate to a centralizer having selectively expandable bow springs.

Description of the Related Art

Centralizers are used to center one tubular member inside a borehole or in another tubular member, e.g., to center a first smaller casing in a second larger casing. Typically centralizers are placed on the exterior of the inner casing and project outwardly therefrom. In many typical situations, the annular space between the outer circumference of the smaller casing and the inner circumference of the larger casing is sufficiently large that, with some force, a centralizer on the inner first casing can be moved into the interior of the second outer casing.

In a variety of situations, the centralizer may pass through a restriction in the wellbore that is smaller than the anticipated annular space. For example, the centralizer may be required to pass through seal bores in a wellhead. As it passes through the wellhead, the radial stand-off force of the bow springs may damage the surface of the bores.

There is a need, therefore, for a centralizer having selectively expandable bow springs.

SUMMARY OF THE INVENTION

Embodiments of the present invention generally relate to an actuatable centralizer for use with a casing. In one embodiment, the bow springs of the centralizers may be retracted to facilitate passage through a restriction. Thereafter, the bow springs may be expanded to support the casing.

In one embodiment, the centralizer may be actuated using a locator plug or other objects released from surface. In another embodiment, the centralizer may be actuated using an unbalanced hydraulic piston. In yet another embodiment, the centralizer may be actuated using a catcher coupled to a pre-existing casing in the wellbore.

In another embodiment, the centralizer may include bow springs having an arcuate outer surface. For example, the arcuate outer surface may have a radius that complements the radius of the pre-existing casing in the wellbore.

In another embodiment, the centralizer may be actuated by breaking down a retaining member. The retaining member may include a dissolvable material and/or a temperature sensitive material. The centralizer may be actuated by exposing the retaining member to a dissolving fluid and/or a predetermined temperature.

In another embodiment, the centralizer may be actuated by breaking down a retaining sleeve having a weakened section.

In one embodiment, a centralizer includes a body having a bore therethrough; a first collar coupled to the body; a second collar coupled to the body; a plurality of bow springs coupled to the first collar and the second collar; and an actuating mechanism for expanding the plurality of bow springs.

In another embodiment, a centralizer includes a body having a bore therethrough; a first collar coupled to the body; a second collar coupled to the body; and a plurality of bow springs coupled to the first collar and the second collar, wherein the bow springs include an arcuate outer surface.

In another embodiment, a method of running a casing in a wellbore includes coupling a centralizer to the casing, wherein the centralizer includes a body having a bore therethrough; a first collar coupled to the body; a second collar movably coupled to the body; and a plurality of bow springs coupled to the first collar and the second collar; retaining the plurality of bow springs in a retracted position; moving the centralizer past a restriction in the wellbore; and actuating the centralizer to cause expansion of the plurality of bow springs.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention provide actuatable centralizers for use with a casing. In one embodiment, the bow springs of the centralizers may be expanded after passing a restriction in the wellbore.

Figure 1:
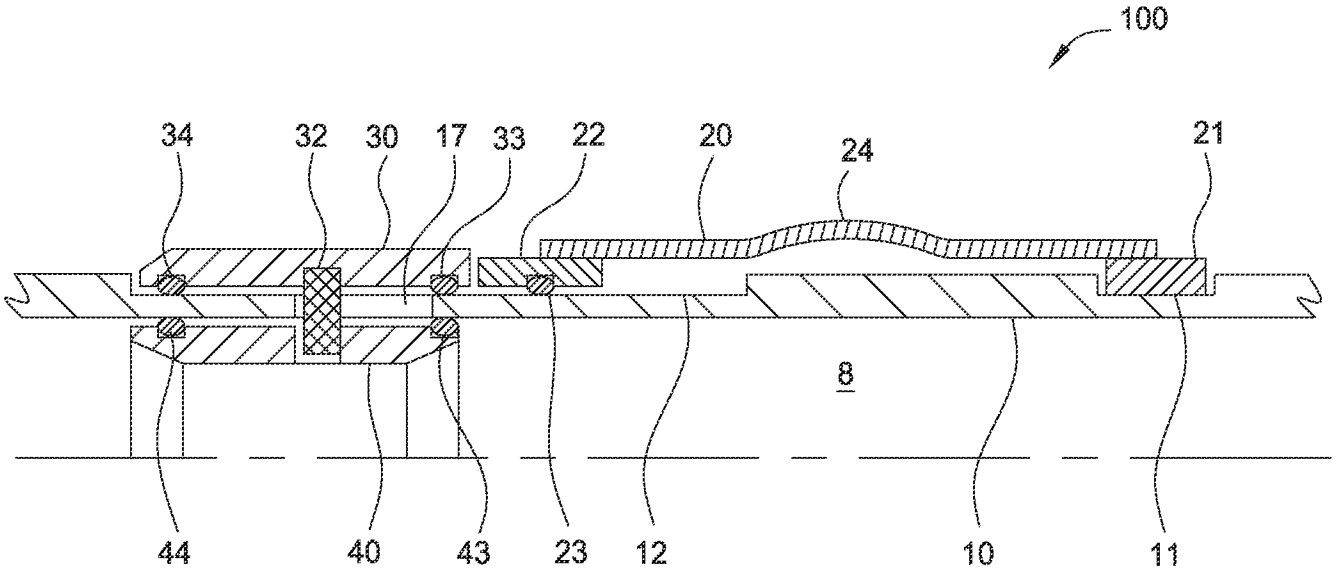
FIG. 1 illustrates a partial cross-sectional view of an embodiment of a centralizer.

FIG. 1 illustrates a partial cross-sectional view of an embodiment of a centralizer 100 suitable for use with a tubular, such as a casing. The centralizer 100 has a tubular body 10 with a longitudinal bore 8 extending therethrough. The body 10 may be connected to a casing or formed integral with the casing. The exterior surface of the body 10 includes two axially spaced collar grooves 11, 12 for receiving a respective collar.

A first collar 21 is fixed to the lower collar groove 11, and a second collar 22 is movably disposed in the upper collar groove 12. In one embodiment, the length of the first collar 21 is about the same size as the lower collar groove 11 such that first collar 21 cannot move axially or moves minimally in the lower collar groove 11. In another embodiment, the first collar 21 may be attached to the lower collar groove 11 using a connector such as a screw, a pin, a weld, an adhesive, and combinations thereof. The upper collar groove 12 is longer than the second collar 22 such that the second collar 22 is axially movable in the upper collar groove 12. The length of the first collar 21 and the second collar 22 may be the same or different. In another embodiment, instead of using grooves 11, 12, the first collar 21 may be fixed to the exterior surface of the body 10, and the second collar 22 may be movable between two end stops formed on the surface of the body 10.

A plurality of bow springs 20 are circumferentially spaced apart around the collars 21, 22 with opposing ends secured to each collar 21, 22. The bow springs 20 are shown in the run-in position, in which the bow springs 20 have not been expanded. In one embodiment, the bow springs 20 have a substantially flat configuration. In another embodiment, the bow springs 20 include a crumpled zone 24 to facilitate expansion of the bow springs 20. For example, the bow springs 20 may include a crumpled zone 24 having a slightly bent section to help initiate expansion of the bow springs 20. In another example, the crumpled zone 24 may be a weaker portion of the bow springs 20 to facilitate expansion.

The bow springs 20 may be expanded using an activating sleeve 30 disposed adjacent the upper collar 22. The activating sleeve 30 is coupled to a receiving sleeve 40 disposed in the bore 8 of the body 10. The sleeves 30, 40 may be coupled using a connector such as a linking pin 32. The pin 32 is axially movable in a slot 17 formed in the body 10. In one embodiment, a plurality of pins and slots are used to couple the sleeves 30, 40. In one example, one or both sleeves 30, 40 may be fixed to the body 10 using a shearable member such as a shear pin. In another example, the sleeves 30, 40 may be fixed to the body 10 using a ratchet or any suitable locking mechanism adapted to selectively retain the sleeves 30, 40 in position. In yet another example, the upper collar 22 may be fixed to the body 10 until actuation. Two or more sealing members 33, 34 such as an o-ring may be disposed between the activating sleeve 30 and the body 10 to prevent fluid communication between the exterior of the centralizer 100 with the bore 8. Sealing members 43, 44 may optionally be disposed between the receiving sleeve 40 and the body 10. In another embodiment, the receiving sleeve 40 may be coupled to the upper collar 21 without using the activating sleeve 30. In this respect, axial movement of the activating sleeve 30 will also move the upper collar 21. The upper collar 21 may be equipped with sealing elements to prevent fluid communication with the bore 8.

In operation, the centralizer 100 is run-in hole in the configuration shown in FIG. 1. In this configuration, the bow springs 20 are retracted, and the centralizer 100 may pass through a wellhead (or other restriction) without damaging the seal bore surfaces. In the retracted configuration, the bow springs 20 do not have stored energy for expansion.

Figure 2:
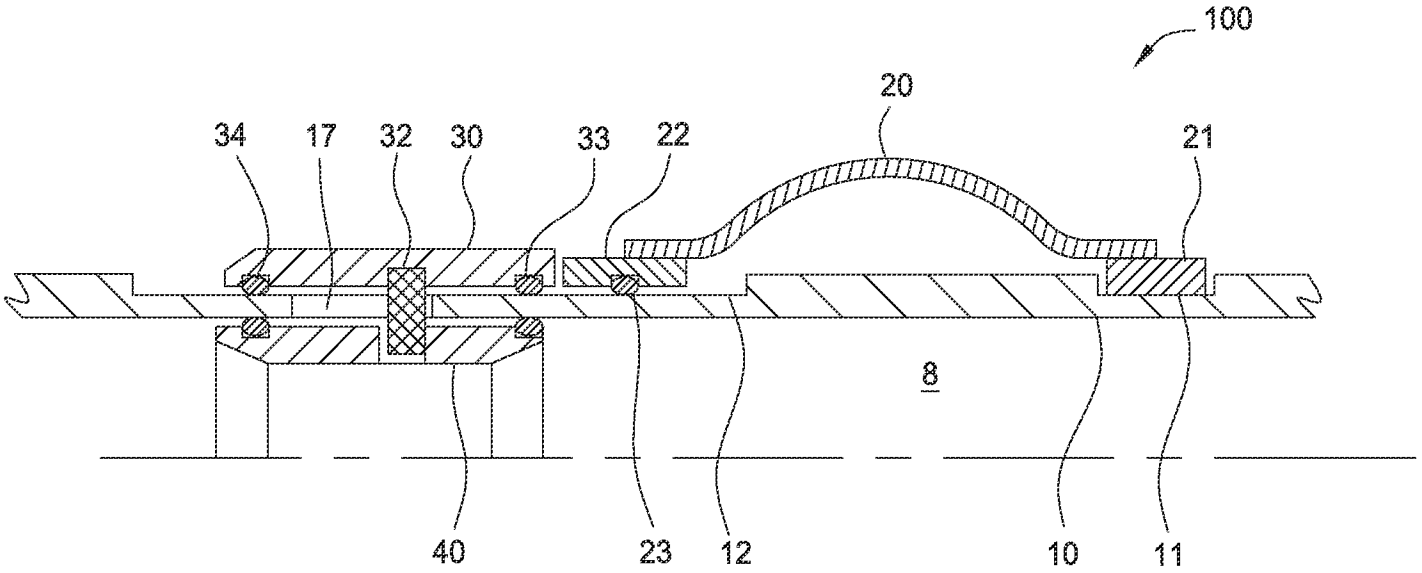
FIG. 2 shows the centralizer of FIG. 1 in an expanded configuration.

After passing through the wellhead, the bow springs 20 may be expanded by applying an actuating force to the receiving sleeve 40. In one embodiment, an object such as a locator plug may be used to apply the actuating force. The locator plug may include a plurality of collets for engaging the receiving sleeve 40. The locator plug may also provide an indication of the plug location while the plug is being displaced. An exemplary locator plug is commercially available through Weatherford International, Inc., which has a place of business in Houston, Tex. The locator plug may land on the receiving sleeve 40 and allow pressure to build above the locator plug. At a predetermined pressure, the shear pin holding the receiving sleeve 40 in position is sheared, thereby freeing the receiving sleeve 40 and the activating sleeve 30 to move relative to the body 10. The fluid pressure causes the receiving sleeve 40 and the activating sleeve 30 to apply an actuating force against the upper collar 22. As the upper collar 22 moves in the lower collar groove 12 toward the lower collar 21, the bow springs 20 are forced outward into the expanded position as shown in FIG. 2. The expansion of the bow springs 20 may initiate at the crumpled zone 24. In one embodiment, the centralizer 100 may include another locking device 23 for retaining the bow springs 20 in the expanded position. Suitable locking devices include a snap ring, a latchet, a ratchet, and any suitable locking device known to a person of ordinary skill in the art. The locking device 23 may be provided on one or more of the upper collar 22, the activating sleeve 30, and the receiving sleeve 40. In another embodiment, the receiving sleeve 40 may be actuated using a ball; a mechanically actuated tubing such as an inner string; or a cementing plug having a collet or suitable gripping mechanisms.

It is contemplated that the actuating system described may be used to set a compression set packer instead of expanding a bow spring. For example, the sealing elements of the packer may be positioned between the upper collar and the lower collar. Movement of the upper collar toward the lower collar will compress the sealing element, thereby urging the sealing element to expand outward.

Figure 3A:
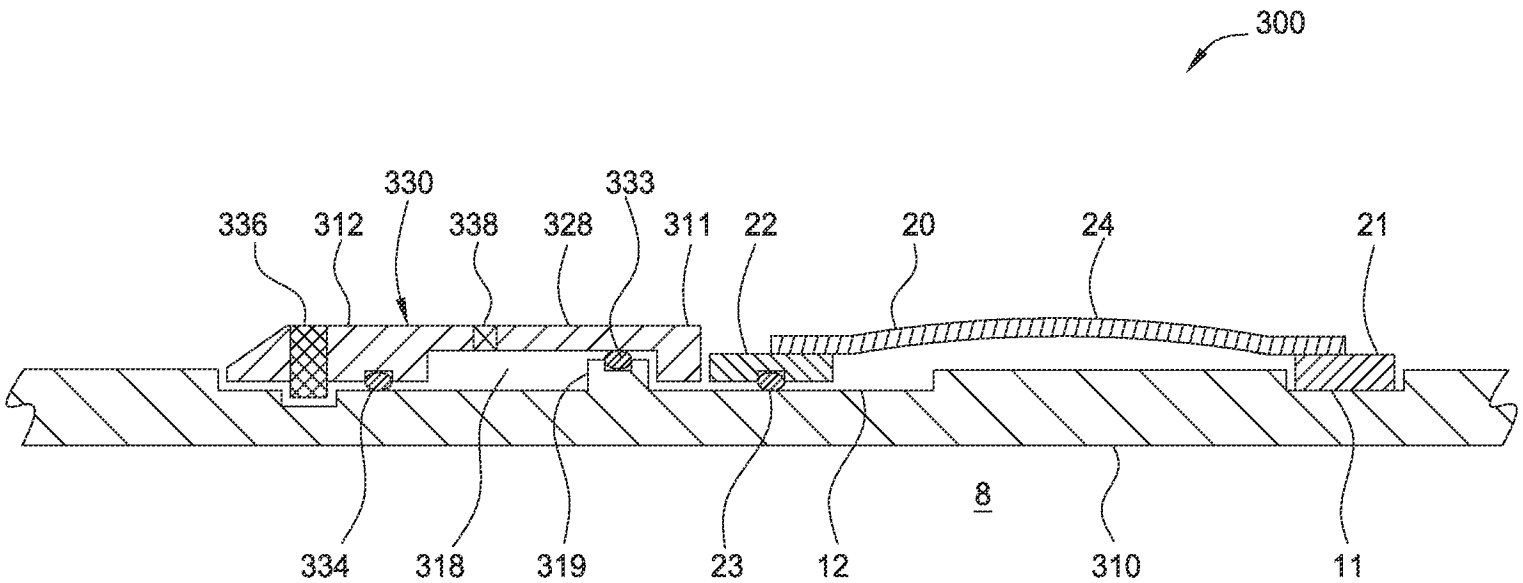
FIG. 3A illustrates a partial cross-sectional view of another embodiment of a centralizer.

FIG. 3A illustrates a partial cross-sectional view of another embodiment of a centralizer 300 suitable for use with a tubular, such as a casing. The centralizer 300 is similar to the centralizer 100 described in FIG. 1, except for the bow spring 20 actuation mechanism. For sake of clarity, similar features shown in both Figures will be designated with the same reference number and will not be described in detail. The bow springs 20 are shown in the run-in position, in which the bow springs 20 have a substantially flat configuration. The bow springs 20 include a crumpled zone 24 to facilitate expansion of the bow springs.

The bow springs 20 may be expanded using an activating sleeve 330 disposed adjacent the upper collar 22. In one embodiment, the activating sleeve 330 is configured to be actuated by the hydrostatic pressure. The activating sleeve 330 may be an unbalanced piston having a lower end 311 positioned adjacent the bow spring 20 and an upper end 312 releasably attached to the body 310 using a shearable member such as a shear screw 336. A sealing member 334 such as an o-ring is positioned between the upper end 312 and the body 310. An inner chamber 318 is formed between the activating sleeve 330, body 310, the upper end 312, and the lower end 311. The body 310 includes a protrusion or an attached sleeve 319 disposed in the chamber 318. The protrusion 319 sealingly contacts an inner surface of the sleeve wall 328 of the activating sleeve 330 using another sealing member 333. In this respect, the sleeve wall 328 has a smaller cross-sectional sealed area than the upper end 312 of the activating sleeve 330. As a result, the activating sleeve 330 will tend to move downward in the response to pressure. The chamber 318 may be at a low pressure such as atmospheric pressure.

In operation, the centralizer 300 may be run-in hole in the configuration shown in FIG. 3A. In this configuration, the centralizer 300 may pass through a wellhead without damaging the seal bores surfaces. In the retracted configuration, the bow springs 20 do not have stored energy for expansion.

Figure 3B:
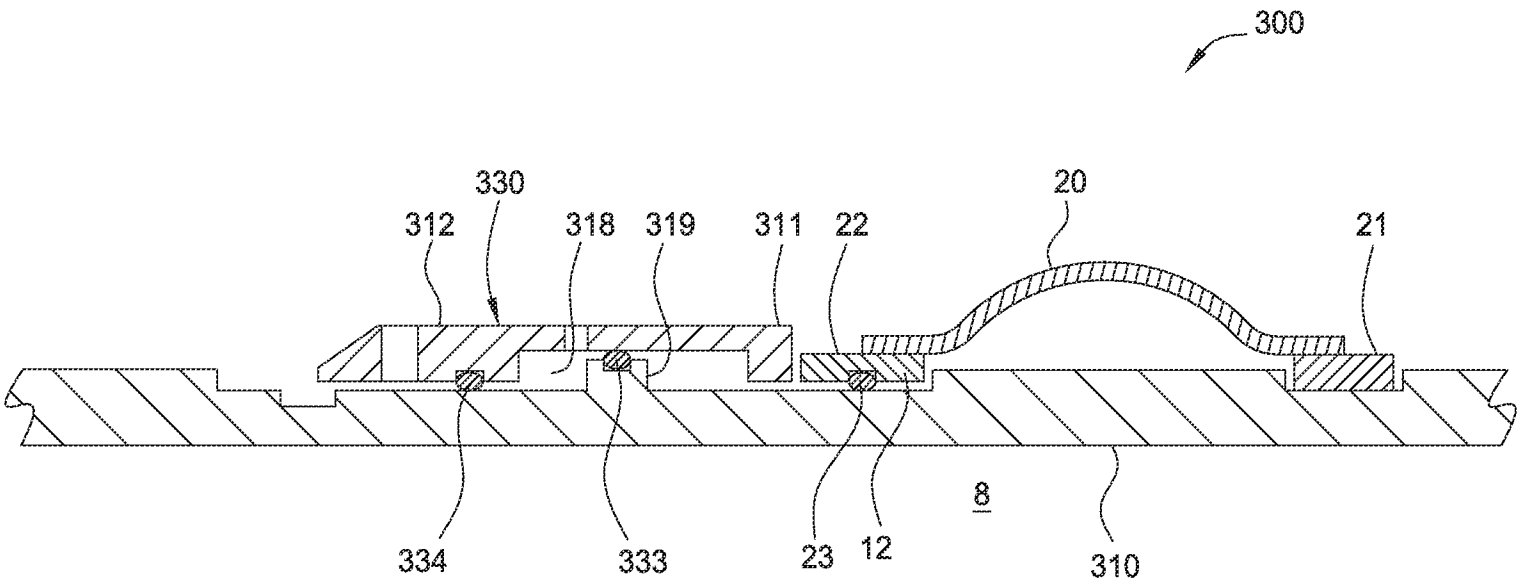
FIG. 3B shows the centralizer of FIG. 3A in an expanded configuration.

After passing the wellhead, the bow springs 20 may be expanded by applying an actuating pressure to the activating sleeve 330. In one embodiment, activating sleeve 330 may be actuated by the hydrostatic pressure at a predetermined depth. When a predetermined force differential across the activating sleeve 330 is reached, the shear screw 336 is sheared to allow the activating sleeve 330 to exert a downward force on the upper collar 22. In turn, the bow springs 20 are forced outward into the expanded position as shown in FIG. 3B. In one embodiment, centralizer 100 may include a locking device 23 for retaining the bow springs 20 in the expanded position. Suitable locking devices include a snap ring, a latch, a ratchet, and any suitable locking device known to a person of ordinary skill in the art. Although the centralizer 300 is shown with the sleeves 30, 40 above the bow springs 20, it is contemplated that the centralizer 300 may be inverted. For example, the sleeves 30, 40 may be positioned below the bow springs 20, such that, during actuation, the sleeves 30, 40 will move upward to expand the bow springs 20.

In yet another embodiment, the activating sleeve 330 may include an optional rupture disk 338 disposed in the sleeve wall 328 as shown in FIG. 3. The rupture disk 338 is configured to burst when the chamber 318 reaches a predetermined pressure. In use, the rupture disk 338 is configured to allow pressure to be relieved from the chamber 318 to prevent collapse of the body 310 or sleeve wall when the hydrostatic pressure is too high, such as due to increased depths.

In yet another embodiment, a rupture disk may be used to actuate the activating sleeve 330 instead of using the shear screw 336. The activating sleeve 330 may be movably coupled to a piston disposed in a piston housing. The piston is initially positioned in the housing such that an upper chamber is formed above the piston and a lower chamber is formed below the piston. The rupture disk is positioned to initially prevent fluid flow into the upper chamber. During run-in, when a predetermined pressure is reached, the rupture disk will burst and expose the upper chamber to the high pressure in the wellbore. As a result, the piston is moved downward, as well as the activating sleeve coupled to the piston.

Figure 4A:
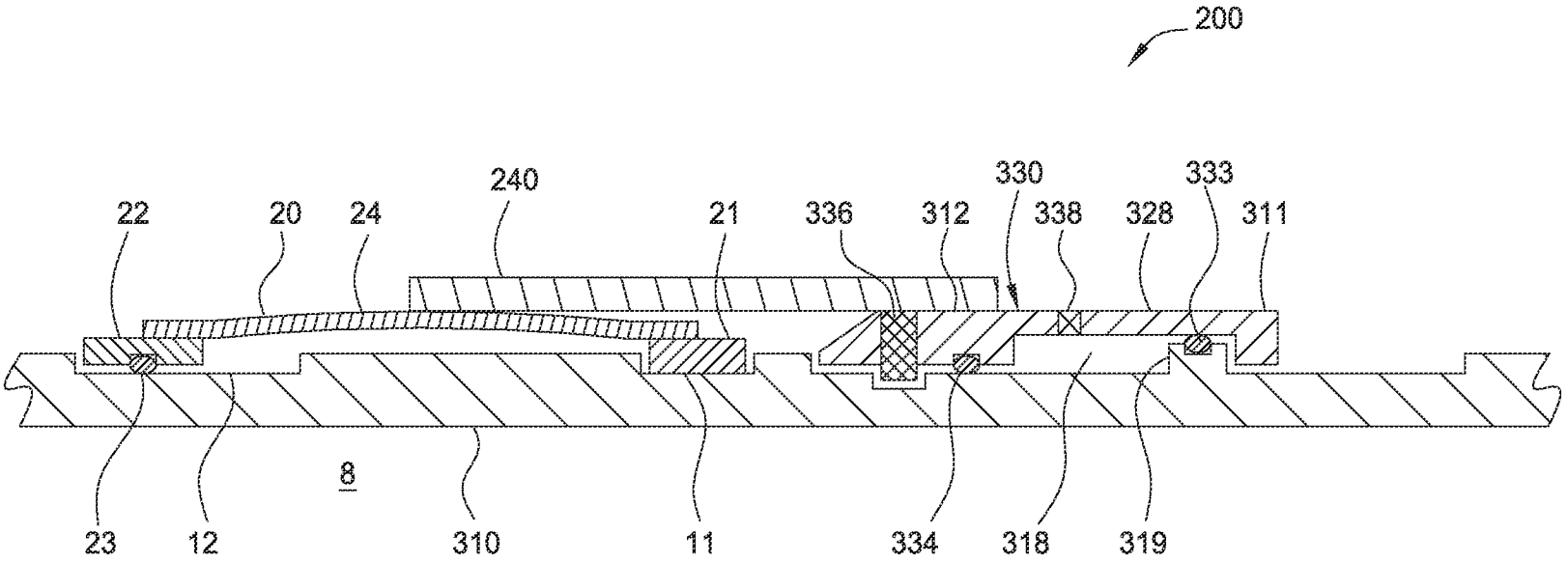
FIG. 4A illustrates a partial cross-sectional view of another embodiment of a centralizer.
Figure 4B:
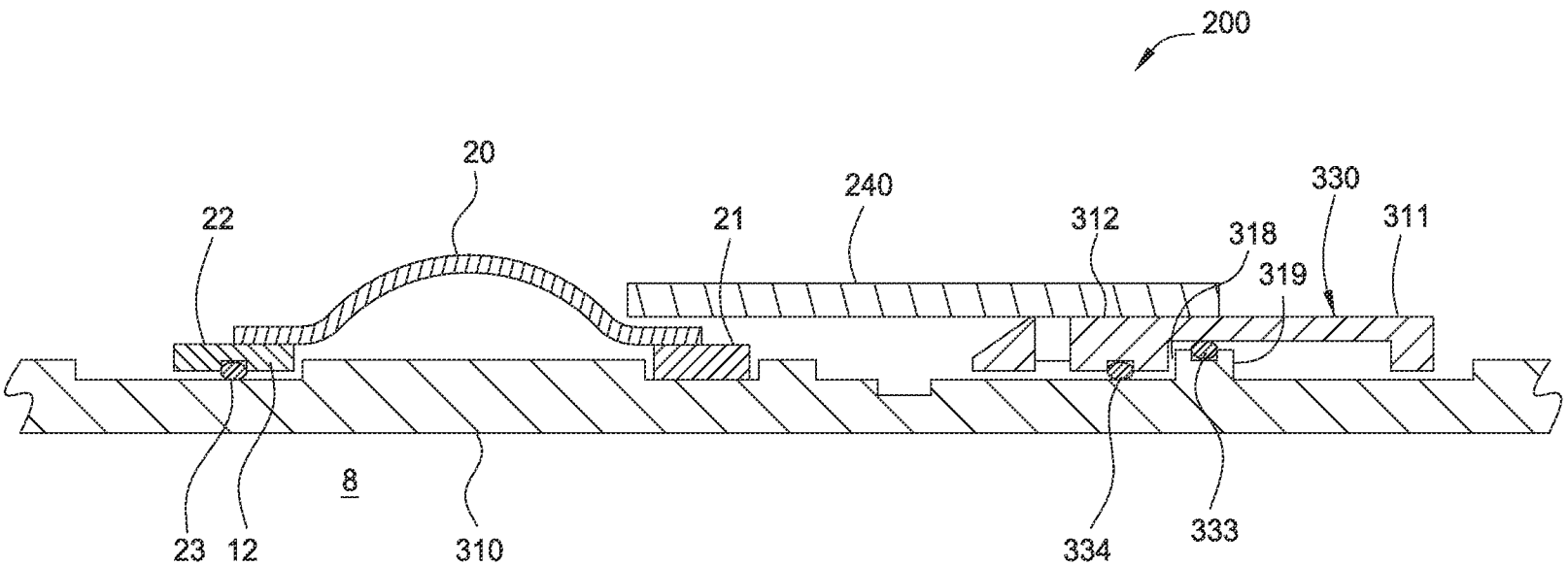
FIG. 4B shows the centralizer of FIG. 4A in an expanded configuration.

In yet another embodiment, the activating sleeve 330 may be used to axially move a cover sleeve 240 used to retain the bow springs 20 in a retracted position, as shown in FIG. 4A. The bow springs 20 are configured to expand when the cover sleeve 240 is removed, as shown in FIG. 4B. The centralizer 200 in FIG. 4A is similar to the centralizer 300 described in FIG. 3A. For sake of clarity, similar features shown in both Figures will be designated with the same reference number and will not be described in detail. The bow springs 20 are shown in the run-in position, in which the bow springs 20 have a substantially flat configuration. The retracted bow springs 20 have stored energy for expansion when the cover sleeve 240 is removed. The bow springs 20 include a crumpled zone 24 to facilitate expansion of the bow springs.

The bow springs 20 may be allowed to expand using an activating sleeve 330 disposed adjacent the lower collar 21. The cover sleeve 240 is attached to the activating sleeve 330. In one embodiment, the activating sleeve 330 is configured to be actuated by the hydrostatic pressure. The activating sleeve 330 may be an unbalanced piston having a lower end 311 positioned adjacent the bow spring 20 and an upper end 312 releasably attached to the body 310 using a shearable member such as a shear screw 336. A sealing member 334 such as an o-ring is positioned between the upper end 312 and the body 310. An inner chamber 318 is formed between the activating sleeve 330, body 310, the upper end 312, and the lower end 311. The body 310 includes a protrusion or an attached sleeve 319 disposed in the chamber 318. The protrusion 319 sealingly contacts an inner surface of the sleeve wall 328 of the activating sleeve 330 using another sealing member 333. In this respect, the sleeve wall 328 has a smaller cross-sectional sealed area than the upper end 312 of the activating sleeve 330. As a result, the activating sleeve 330 will tend to move downward in the response to pressure. The chamber 318 may be at a low pressure such as atmospheric pressure. In another embodiment, the cover sleeve 240 may be moved using the activating sleeve 30 of FIG. 1.

In operation, the centralizer 300 may be run-in hole in the configuration shown in FIG. 4A. The bow springs 20 are retained in the retracted configuration using the cover sleeve 240. In this configuration, the centralizer 300 may pass through a wellhead without damaging the seal bores surfaces.

After passing the wellhead, the bow springs 20 may be expanded by applying an actuating pressure to the activating sleeve 330. In one embodiment, activating sleeve 330 may be actuated by the hydrostatic pressure at a predetermined depth. When a predetermined force differential across the activating sleeve 330 is reached, the shear screw 336 is sheared to allow the activating sleeve 330 to move away from the bow springs 20. Movement of the activating sleeve 330 also removes the cover sleeve 240 from the bow springs 20. The stored energy in the bow springs 20 expands the bow springs 20 outward, as shown in FIG. 4B.

Figures 5A, 5B:
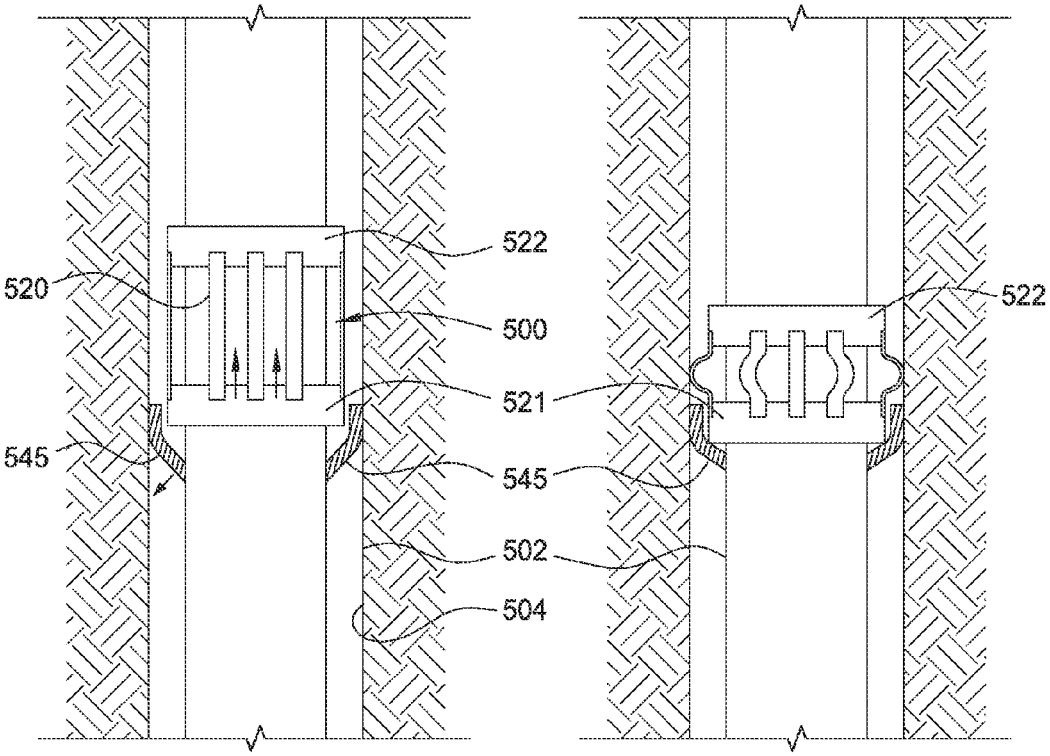
FIGS. 5A and 5B illustrate another embodiment of a centralizer.

FIGS. 5A and 5B illustrate another embodiment of a centralizer 500 suitable for use with a tubular, such as a casing 502. FIG. 5A shows the centralizer 500 before expansion, and FIG. 5B shows the centralizer 500 after expansion. The casing 502 and the centralizer 500 are shown disposed in a pre-existing casing 504. As shown, the centralizer 500 includes a first collar 521 movably disposed around the casing 502 and a second collar 522 is fixed to the casing 502. In one embodiment, the first collar 521 and the second collar 522 may be coupled directly to the exterior surface of the casing 502. In another embodiment, the first collar 521 and the second collar 522 may be coupled to a respective collar groove in the casing 502. A plurality of bow springs 520 are spaced apart around the collars 521, 522 with opposing ends secured to each collar 521, 522. The bow springs 520 are shown in the run-in position, in which the bow springs 520 have a substantially flat configuration. The bow springs 520 may include a crumpled zone to facilitate expansion of the bow springs 520.

One or more collar catchers 545 for engaging the movable collar 521 may be coupled to the pre-existing casing 504. The collar catcher 545 may be a flexible seat formed by a plurality of fingers and having an inner diameter sized to "catch" the movable collar 521 as the casing 502 moves through the catcher 545. The catcher 545 is configured to engage the movable collar 521 such that continued downward movement of the casing 502 moves the casing 502 relative to the movable collar 521. In turn, the fixed collar 522 is moved closer to the movable collar 521, thereby causing the bow springs 520 to expand outward. FIG. 5B shows the movable collar 521 being closer to the fixed collar 522 and the bow springs 520 after expansion. The expanded bow springs 520 then exerts a downward force on the catcher 545 that causes the catcher 545 to flex outward. As a result, the catcher 545 is forced open to allow the centralizer 500 to pass. In one embodiment, the centralizer 500 may include a locking device for retaining the bow springs 520 in the expanded position. Suitable locking devices include a snap ring, a latchet, a ratchet, and any suitable locking device known to a person of ordinary skill in the art.

In yet another embodiment, the catcher may be configured to catch a cover sleeve used to retain the bow springs in a retracted position. The catcher may pull off the cover sleeve as the centralizer passes through the catcher, thereby allowing the bow springs to expand.

Figure 6A:
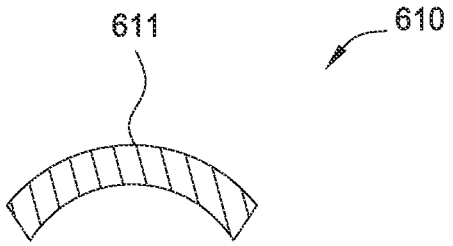
FIGS. 6A to 6C illustrate various exemplary embodiments of a bow spring having an arcuate outer surface.
Figure 6B:
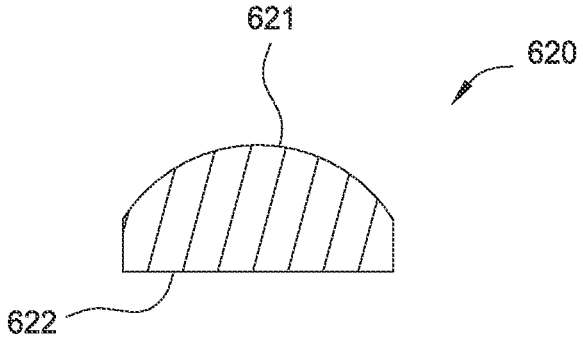

In another embodiment, the centralizer may include bow springs configured with an outer circumferential radius that complements the radius of the pre-existing casing. FIG. 6A illustrates a cross-sectional view in the axial direction of an exemplary bow spring 610 having an arcuate outer surface 611. As shown, the bow spring 610 is curved radially to complement the casing. FIG. 6B illustrates a cross-sectional view in the axial direction of another exemplary bow spring 620 having an arcuate outer surface 621. As shown, the bow spring 620 has a unitary body having a flat inner surface 622 and an arcuate outer surface 621. It is contemplated that embodiments of the bow springs disclosed herein may be used with any embodiments of the centralizers disclosed herein.

Figure 6C:
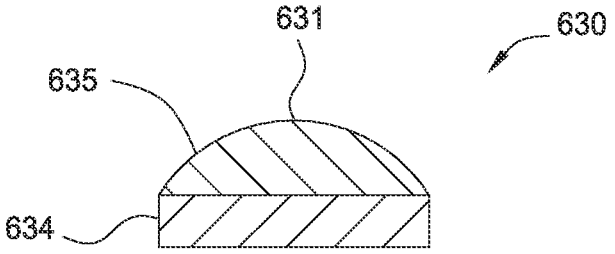

FIG. 6C illustrates a cross-sectional view in the axial direction of another exemplary bow spring 630 having an arcuate outer surface 631. As shown, the bow spring 630 includes a flat spring body 634 and at least one coating 635 that forms the curved outer surface on the spring body 634. In one embodiment, the coating 635 may be a soft metal coating such as aluminum, copper, zinc, or combinations thereof; a friction reducing material; or an epoxy such as a ceramic material that is applied by brushing or spraying. In one example, the coating 635 may be a hard metal coating such as a tungsten carbide coating. An exemplary hard metal coating is Hardide®, which is available through Hardide Coatings. It is contemplated that bow spring 630 may include a plurality of layers of material such as a spray welded aluminum or zinc coating and a hard metal coating. It is further contemplated that a coating 635 may also be applied to an arcuate spring body such as the embodiment of FIG. 6A. In yet another embodiment, the bow spring 630 may be a heat treated steel bow spring.

Figure 7:
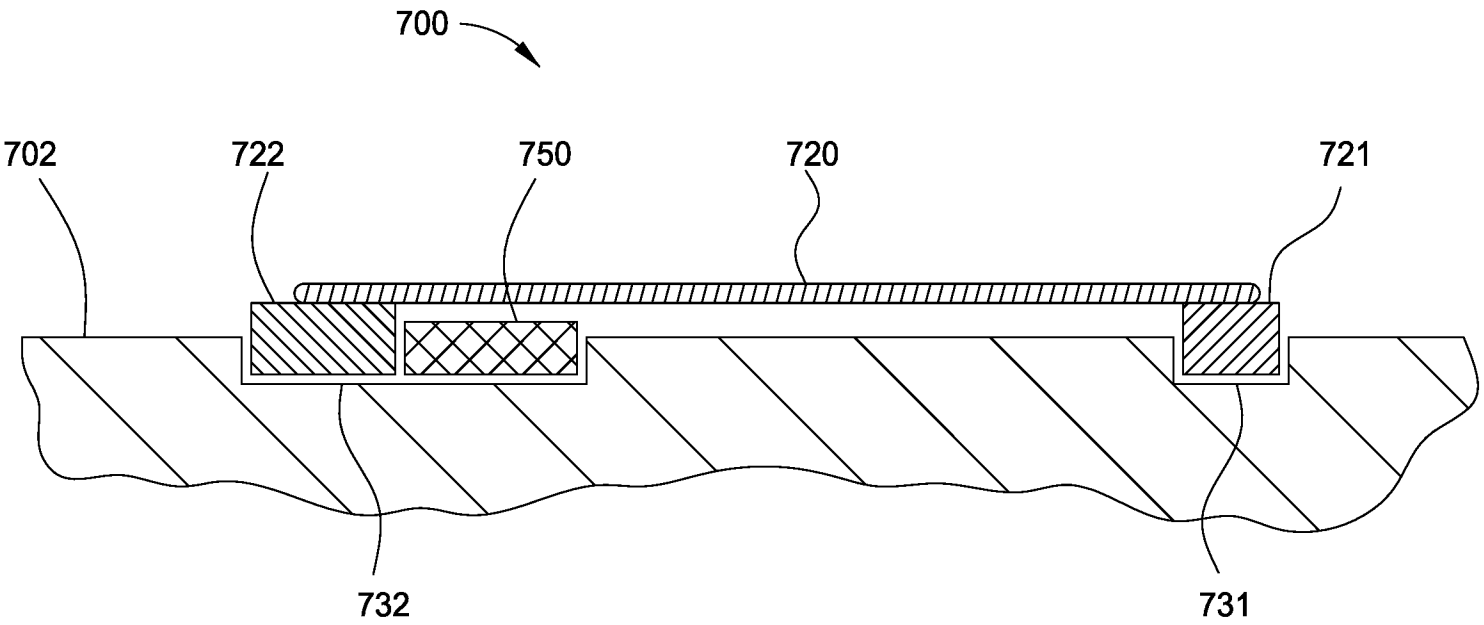
FIG. 7 illustrates a perspective view of another embodiment of a centralizer.

FIG. 7 illustrates a perspective view of another embodiment of a centralizer 700 suitable for use with a tubular, such as a casing 702. As shown, the centralizer 700 includes a first collar 721 disposed in a first groove 731 and a second collar 722 movably disposed in a second groove 732 of the casing 702. A plurality of bow springs 720 are spaced apart around the collars 721, 722 with opposing ends secured to each collar 721, 722. The bow springs 720 are shown in the run-in position, in which the bow springs 720 are in a retracted configuration. The bow springs 720 have stored energy such that they will flex to the expanded configuration when the second collar 722 is free to move.

In one embodiment, a retaining member 750 is disposed in the second groove 732 adjacent the side of the second collar 722 closer to the first collar 721. The retaining member 750 prevents the second collar 722 from moving towards the first collar 721. In one embodiment, the retaining member 750 is a ring made of a dissolvable material. The retaining member 750 may be dissolved or weakened upon activation by a chemical, a certain temperature, or combinations thereof. The retaining member 750 may be dissolved by contact with an acid, such as fluoric acid. In one example, dissolving fluid (e.g., the acid) may be circulated downhole for contact with the retaining member 750. In another embodiment, the retaining member 750 may be made of a material that dissolves or breaks down when exposed to wellbore fluids. The dissolving process may occur over several minutes to several hours. The dissolving material is preferably a water soluble, synthetic polymer composition including a polyvinyl, alcohol plasticizer and mineral filler. Dissolvable material is available from Oil States Industries of Arlington, Tex., U.S.A. An exemplary dissolvable polymer is polyglycol acid, which may dissolve via hydrolysis in water. Other suitable dissolvable material includes salts, such as sodium chloride and potassium chloride; sodium tallow; aluminum; and titanium. In one example, aluminum may be dissolved by using an acid or alkaline solution, and titanium may be dissolved by contact with hydrofluoric acid.

In another embodiment, the retaining member 750 may be made of temperature sensitive material, which may dissolve or breakdown at a certain temperature. Exemplary temperature sensitive materials include phenolics, composites, resins, waxes, rubber, urethanes, thermoplastics, and other suitable material known to a person of ordinary skill in the art. Exemplary temperature activated polymers include polypropylene, ultra-high-molecular-weight polyethylene ("UHMWPE"), Nylon 6 (also known as polycaprolactam), and combinations thereof.

In another embodiment, the temperature sensitive material and/or dissolvable material may be used to form one or more weak spots in the retaining member 750.

In use, after the retaining member 750 is exposed to the particular dissolving fluid and/or certain temperature, the retaining member 750 will weaken sufficiently to allow the second collar 722 to move toward the first collar 721, which in turn, allows the bow spring 720 to flex outward.

Figure 8:
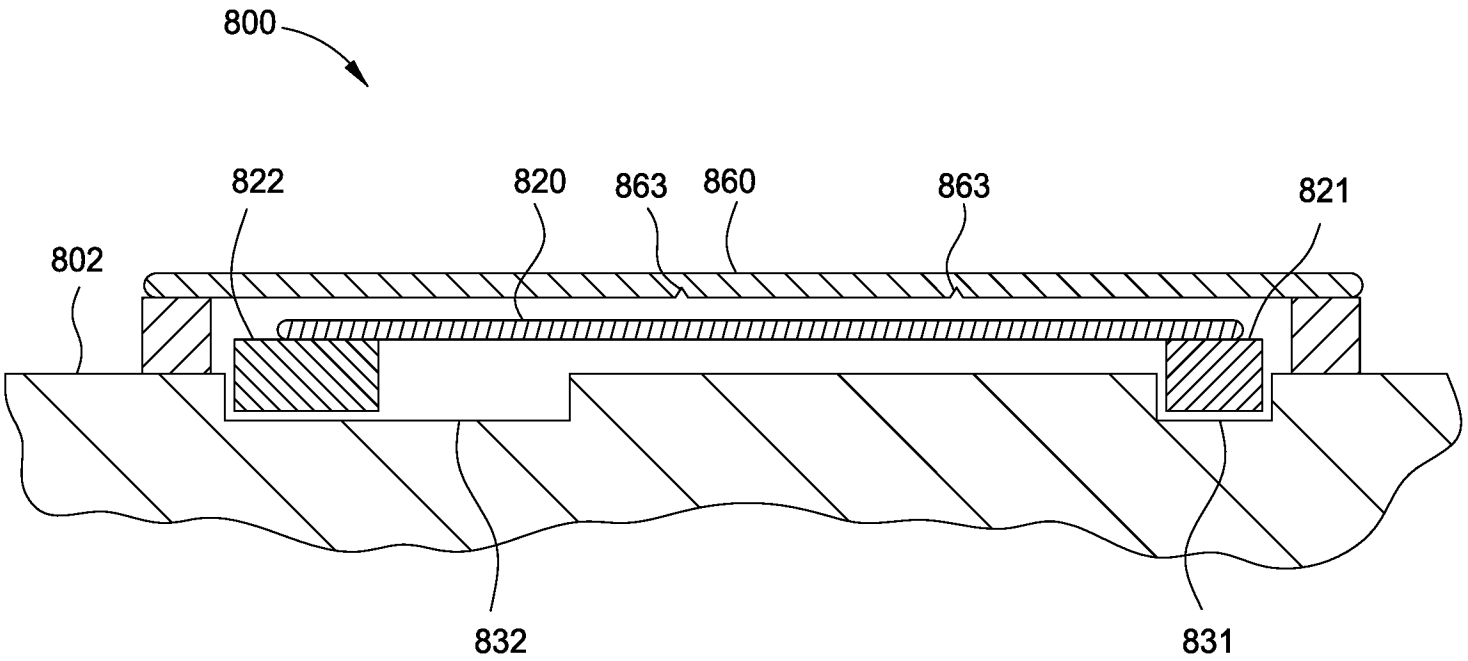
FIG. 8 illustrates another embodiment of a centralizer.

FIG. 8 illustrates a perspective view of another embodiment of a centralizer 800 suitable for use with a tubular, such as a casing 802. As shown, the centralizer 800 includes a first collar 821 disposed in a first groove 831 and a second collar 822 movably disposed in a second groove 832 of the casing 802. A plurality of bow springs 820 are spaced apart around the collars 821, 822 with opposing ends secured to each collar 821, 822. The bow springs 820 are shown in the run-in position, in which the bow springs 820 are in a retracted configuration. The bow springs 820 have stored energy such that they will flex to the expanded configuration when the second collar 822 is free to move.

A retaining sleeve 860 is provided to retain the bow springs 820 in a retracted configuration. The retaining sleeve 860 may include one or more weakened section to cause the sleeve 860 to collapse when exposed to a predetermined pressure. For example, the retaining sleeve 860 may be scored to create the weakened sections. As shown, the inner surface of the sleeve 860 includes scored sections 863 to facilitate collapse of the sleeve 860. Upon collapse, scored sections 863 may create openings in the sleeve 860 to allow the bow springs 820 to expand radially outward.

In one embodiment, a centralizer includes a body having a bore therethrough; a first collar coupled to the body; a second collar coupled to the body; a plurality of bow springs coupled to the first collar and the second collar; and an actuating mechanism for expanding the plurality of bow springs.

In one or more of the embodiments described herein, the actuating mechanism includes a sleeve selectively movable relative to the body.

In one or more of the embodiments described herein, the sleeve comprises an unbalanced piston.

In one or more of the embodiments described herein, the actuating mechanism includes an inner sleeve coupled to an outer sleeve.

In one or more of the embodiments described herein, the inner sleeve is configured to receive an object released from a location above the centralizer.

In one or more of the embodiments described herein, the centralizer includes a locking device for retaining the bow springs in an expanded configuration.

In one or more of the embodiments described herein, the bow springs include a crumpled zone.

In one or more of the embodiments described herein, the actuating mechanism comprises chemical actuation, temperature actuation, and combinations thereof.

In one or more of the embodiments described herein, the actuating mechanism includes a dissolvable material, a temperature sensitive material, and combinations thereof.

In one or more of the embodiments described herein, the actuating mechanism includes a catcher coupled to a pre-existing casing, and wherein the catcher is configured to limit movement of at least one of the first collar and the second collar.

In one or more of the embodiments described herein, the catcher includes a plurality of fingers for engaging at least one of the first collar and the second collar and wherein the plurality of fingers are expandable to allow the first collar and the second collar to past through.

In one or more of the embodiments described herein, the actuating mechanism includes a retaining sleeve having a weakened section.

In one or more of the embodiments described herein, the first collar is substantially fixed relative to the body and the second collar is movable relative to the body.

In one or more of the embodiments described herein, the actuating mechanism moves the second collar to toward the first collar.

In one or more of the embodiments described herein, the plurality of bow springs include stored energy configured to move the second collar to the first collar when the stored energy is released.

In another embodiment, a centralizer includes a body having a bore therethrough; a first collar coupled to the body; a second collar coupled to the body; and a plurality of bow springs coupled to the first collar and the second collar, wherein the bow springs include an arcuate outer surface.

In one or more of the embodiments described herein, the bow springs are curved.

In one or more of the embodiments described herein, the bow springs include a coating having the arcuate outer surface.

In one or more of the embodiments described herein, the coating comprises a soft metal coating, a hard metal coating, and combinations thereof.

In another embodiment, a method of running a casing in a wellbore includes coupling a centralizer to the casing, wherein the centralizer includes a body having a bore therethrough; a first collar coupled to the body; a second collar movably coupled to the body; and a plurality of bow springs coupled to the first collar and the second collar; retaining the plurality of bow springs in a retracted position; moving the centralizer past a restriction in the wellbore; and actuating the centralizer to cause expansion of the plurality of bow springs.

In one or more of the embodiments described herein, actuating the centralizer comprises applying a force to an activating sleeve configured to move the second collar.

In one or more of the embodiments described herein, the activating sleeve is coupled to a receiving sleeve configured to receive a dropped or pumped object.

In one or more of the embodiments described herein, the object comprises a locator plug or a cementing plug having a collet.

In one or more of the embodiments described herein, actuating the centralizer comprises coupling a catcher to the wellbore, and catching the second collar using the catcher.

In one or more of the embodiments described herein, actuating the centralizer comprises breaking down a retaining member used to retain the plurality of bow springs in the retracted position.

In one or more of the embodiments described herein, actuating the centralizer comprises actuating an unbalanced sleeve configured to move the second collar.

While the foregoing is directed to embodiments of the present invention, other and further embodiments of the invention may be devised without departing from the basic scope thereof, and the scope thereof is determined by the claims that follow.

The invention claimed is:

1. A centralizer, comprising:

a body having a bore therethrough;

a first collar coupled to the body;

a second collar coupled to the body;

a plurality of bow springs coupled to the first collar and the second collar; and an actuating mechanism for expanding the plurality of bow springs, wherein the actuating mechanism includes an inner sleeve coupled to and movable in a same direction with an outer sleeve.

2. The centralizer of claim 1, wherein the inner sleeve is configured to receive an object released from a location above the centralizer.

3. The centralizer of claim 1, further comprising a locking device for retaining the bow springs in an expanded configuration.

4. The centralizer of claim 1, wherein the bow springs include a crumpled zone.

5. The centralizer of claim 1, wherein the actuating mechanism includes a retaining sleeve having a weakened section.

6. The centralizer of claim 1, wherein the first collar is substantially fixed relative to the body and the second collar is movable relative to the body.

7. The centralizer of claim 6, wherein the actuating mechanism moves the second collar to toward the first collar.

8. The centralizer of claim 6, wherein the plurality of bow springs include stored energy configured to move the second collar to the first collar when the stored energy is released.

9. The centralizer of claim 1, wherein the inner sleeve is disposed inside the body and the outer sleeve is disposed outside the body.

10. The centralizer of claim 9, wherein the inner sleeve is configured to receive an object released from a location above the centralizer.

11. The centralizer system of claim 9, wherein at least one seal is disposed between the outer sleeve and the body or the inner sleeve and the body.

12. The centralizer of claim 1, wherein at least one of the first and second collar is disposed in a groove of the body.

13. The centralizer of claim 1, wherein the outer sleeve is configured to move at least one of the first collar and second collar relative to the body to expand the plurality of bow springs.

14. A centralizer, comprising:

a body having a bore therethrough;

a first collar coupled to the body;

a second collar coupled to the body; and a plurality of bow springs coupled to the first collar and the second collar, wherein a cross-section of the bow springs includes an arcuate outer surface and a flat inner surface.

15. The centralizer of claim 14, wherein the bow springs include a coating having the arcuate outer surface.

16. The centralizer of claim 15, wherein the coating comprises a soft metal coating, a hard metal coating, or combinations thereof.

17. A centralizer system for use in a casing, comprising:

a centralizer comprising:

a body having a bore therethrough;

a first collar coupled to the body;

a second collar coupled to the body; and a plurality of bow springs coupled to the first collar and the second collar; and a flexible catcher coupled to the casing, and wherein the catcher is configured to move at least one of the first collar and the second collar relative to the other collar to expand the plurality of bow springs.

18. The centralizer of claim 17, wherein the catcher includes a plurality of fingers for engaging at least one of the first collar and the second collar and wherein the plurality of fingers are expandable to allow the first collar and the second collar to past through.

19. The centralizer system of claim 17, wherein at least one of the first and second collar is disposed in a grove of the body.

20. The centralizer system of claim 17, further comprising a locking device for retaining the bow springs in an expanded configuration.

* * * * *